United States Patent [19]

Sokolovsky

[11] 4,388,855

[45] Jun. 21, 1983

[54] FIREARM PNEUMATIC SLIDE DECELERATOR ASSEMBLY

[76] Inventor: Paul J. Sokolovsky, 641 Torrington Dr., Sunnyvale, Calif. 94087

[21] Appl. No.: 194,680

[22] Filed: Oct. 6, 1980

[51] Int. Cl.[3] ..... F41D 11/12

[52] U.S. Cl. ..... 89/198; 89/196

[58] Field of Search ..... 89/196, 198

[56] References Cited

U.S. PATENT DOCUMENTS 900,865 10/1908 Louis ..... 89/196

1,749,137 3/1930 Hudson ..... 89/198

3,298,282 1/1967 Löffler et al. ..... 89/198

3,901,125 8/1975 Raville ..... 89/196

*Primary Examiner*—Stephen C. Bentley

*Attorney, Agent, or Firm*—Warren M. Becker

[57] ABSTRACT

A slide decelerator assembly for a firearm (1), having a slide (2) which moves rearwards when the firearm (1) is fired is described comprising means (12, 13) for compressing air in response to said rear movement of said slide 2for retarding said rear slide movement.

5 Claims, 18 Drawing Figures

FIG. 1
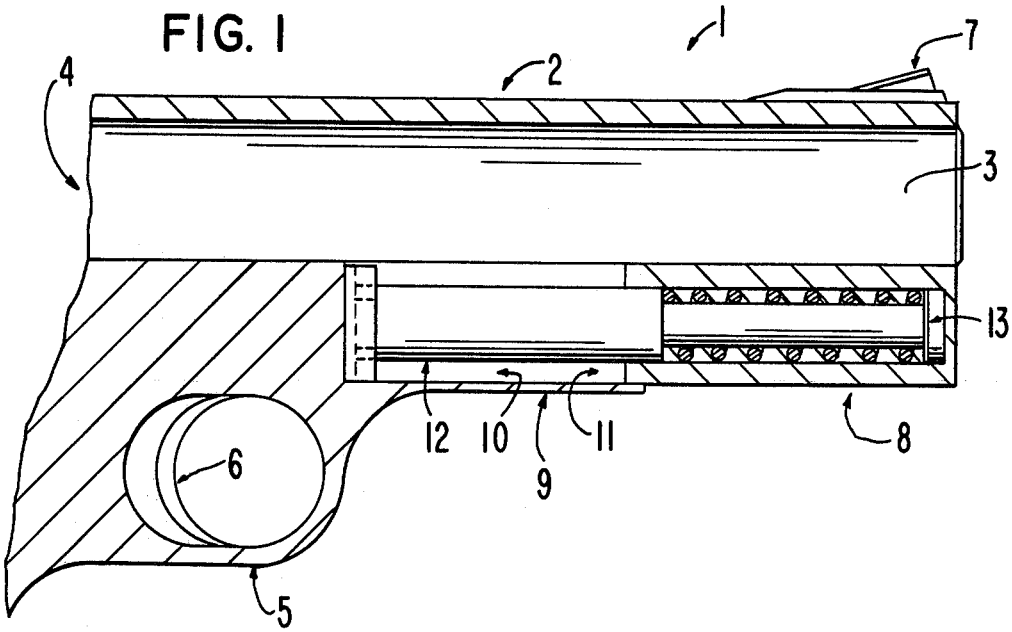
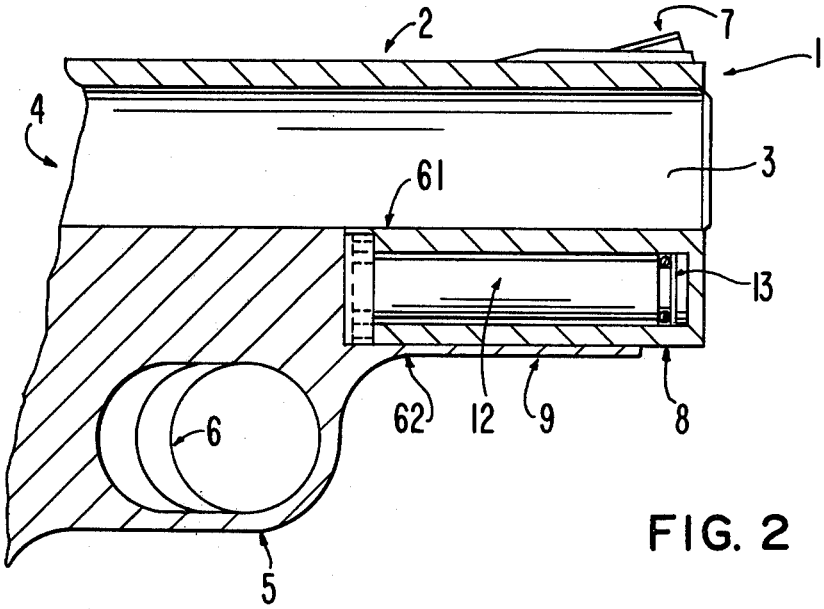
FIG. 2

FIREARM PNEUMATIC SLIDE DECELERATOR ASSEMBLY

BACKGROUND OF THE INVENTION

The present invention relates in general to apparatus for retarding the movement of movable parts in a firearm which move in response to a firing of the firearm. In particular, the invention relates to a novel pneumatic slide decelerator assembly for retarding the movement of a movable slide which moves in response to a firing of the firearm.

Many firearms comprise movable members which move in response to a firing of the firearm. The violent rear movement of the members, especially the heavy members, such as the slide, is frequently undesirable. It often results in a severe physical shock to the user thereof and makes controlling the position of the firearm and hence accurate repeated firing of the firearm difficult to achieve. For these reasons various apparatus and methods have been employed to retard the movement of the heavier firearm parts, such as the slide assemblies in prior known firearms.

The two principal methods for retarding the movement of a firearm slide involve the use of spring assemblies and gases generated from the exploding charge when the firearm is fired.

One of the disadvantages of spring assemblies is that it is often difficult to adjust the amount of retardation of the slide rear movement which may be desirable when employing different charges. Another disadvantage is that a relatively strong spring is often required to provide the necessary slide rear movement retardation.

The use of gases generated from the burning charge for providing slide movement retardation typically requires expensive and time-consuming fabrication of firearm parts and passageways in the firearm housing to utilize the gases thus generated.

SUMMARY OF THE INVENTION

In view of the foregoing a principal object of the present invention is a slide decelerator assembly for a firearm having a slide which moves rearwards when the firearm is fired comprising means, including means for compressing air responsive to a rear movement of the slide for retarding said movement of said slide.

Another object of the present invention is a slide decelerator assembly as described above wherein the slide rear movement retarding means comprises means for adjusting the rate of retardation of said rear movement of said slide.

still another object of the present invention is a slide decelerator assembly as described above wherein the air compressing means comprises a cylinder for containing compressed air, a piston means for compressing air in the cylinder and means for removing compressed air from the cylinder at controllable and adjustable rates.

Still another object of the present invention is a slide decelerator assembly as described above comprising means including air compressing means in combination with spring means for retarding movement of said slide.

Principal features of the present invention in accordance with the above objects is a slide decelerator assembly comprising a slide cylinder and a slide piston. In operation, the slide piston is caused to move into the cylinder when the firearm is fired compressing air in the cylinder and retarding rear movement of the slide. As the air in the cylinder is compressed a controlled amount of the air is permitted to escape to the atmosphere through a hole provided therefore in the piston. Means are provided for adjusting the size of the hole to change the rate of the air escaping and thereby to control the magnitude of the retardation.

In addition to compressing air to effect slide movement retardation, a spring member is also provided for retarding slide rear movement and for forward or return movement for reload and to repeat fire.

In general the embodiments of the invention are relatively easy to fabricate, have a minimum of movable parts and are typically reliable and economical.

BRIEF DESCRIPTION OF THE DRAWING

The above and other objects, features and advantages of the present invention will become apparent from the following detailed description of the accompanying drawing in which:

FIG. 1 is a partial cross-sectional view of a firearm incorporating the present invention with its slide in a normal position prior to the firing thereof.

FIG. 2 is a partial cross-sectional view of the firearm of FIG. 1 after the firearm is fired and the slide thereof is moved to its most rearward position in response to the firing thereof.

DETAILED DESCRIPTION OF THE DRAWING

Figures 3, 4, 5, 6, 7, 8, 9, 10, 11, 12, 13, 14, 15, 16, 17, 18:
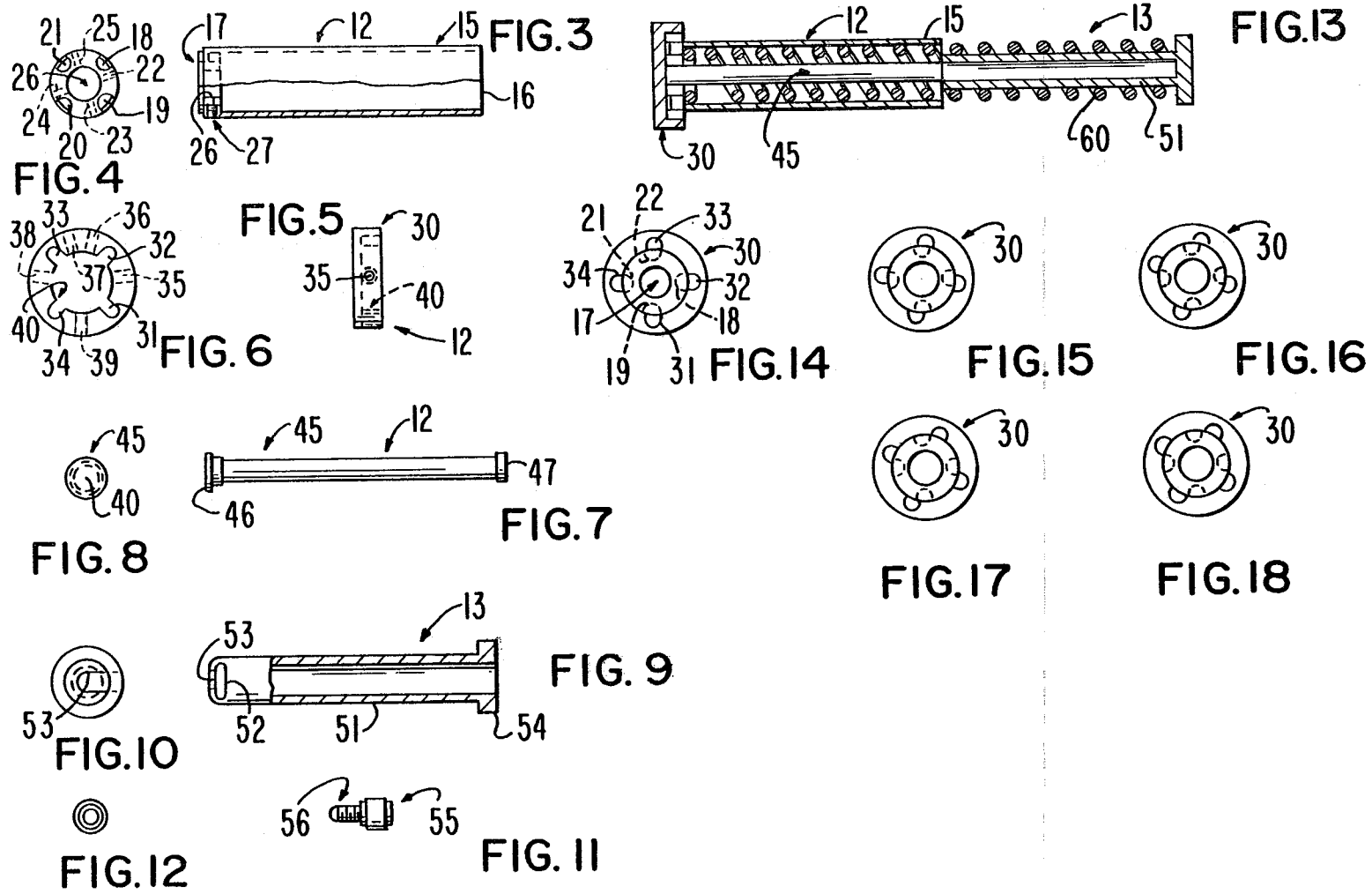
FIG. 3 is a side cross-sectional view of a piston member according to the present invention.
FIG. 4 is an end view of FIG. 3.
FIG. 5 is a side cross-sectional view of a base member according to the present invention.
FIG. 6 is an end view of FIG. 5.
FIG. 7 is a stud retainer member according to the present invention.
FIG. 8 is an end view of FIG. 7.
FIG. 9 is a partial cross-sectional view of a spring guide member according to the present invention.
FIG. 10 is an end view of FIG. 9.
FIG. 11 is a side view of a set screw according to the present invention.
FIG. 12 is an end view of FIG. 11.
FIG. 13 is a cross-sectional view of the assembled parts of FIGS. 3–11.
FIGS. 14–18 are end views of the parts of FIGS. 3–6 showing various vent openings possible for various relative positions thereof.

Referring to FIGS. 1–13, there is provided in accordance with the present invention a firearm designated generally as 1. The firearm 1 is provided with a slide assembly 2 including a barrel 3 mounted on a housing designated generally as 4. For purposes of the description of the present invention, only the forward portions of the firearm 1 are deemed necessary to be disclosed and described.

In the housing 4 there is provided a trigger housing designated generally as 5. The housing 5 is provided for housing one or more trigger members designated generally as 6.

At the upper forward end of the slide 2 there is provided a sighting member designated generally as 7. On the underside of the slide 2 opposite the sighting member 7 there is provided a hollow slide cylinder designated generally as 8. Extending forwardly from the trigger housing 5 and at the upper end thereof there is provided a housing designated generally as 9 forming a cavity 10 for slidably receiving the cylinder 8. Centrally mounted in the interior of the cylinder 8 and cavity 10 there is provided a slide piston and spring guide assembly designated generally as 11 comprising a piston assembly designated generally as 12 and spring guide member designated generally as 13 as will be described in further detail with respect to FIGS. 3–13.

Referring to FIGS. 3 and 4, there is provided in the piston assembly 12 a hollow tubular member 15 having an open end at 16 and a closed end 17. Extending through the closed end 17 there is provided a plurality of holes forming air passageways 18, 19, 20 and 21 as seen more clearly in FIG. 4. Located between the holes 18, 19, 20 and 21 there is provided a plurality of set screw receiving holes 22, 23, 24 and 25 for receiving the set screw to be described with respect to FIGS. 11 and 12. Centrally located in the closed end 17, there is provided still another hole 26 for receiving a stud retainer designated generally as 45 which will be described below with respect to FIGS. 7 and 8. Adjacent to the closed end 17 there are also provided threads designated generally as 27 for threading on the member 15 a base member designated generally as 30 which will be described below with respect to FIGS. 5 and 6.

Referring to FIGS. 5 and 6, there is provided in the base member 30 a plurality of recesses 31, 32, 33 and 34. Located between the recesses 31, 32, 33 and 34 there is provided a plurality of set screw receiving holes 35, 36, 37, 38 and 39.

The base member 30 is formed as a cap member having in its interior wall threads designated generally as 40 for threading the base member 30 onto the closed end 17 of the hollow tubular member 15 described above with respect to FIGS. 3 and 4.

Referring to FIGS. 7 and 8, the stud retainer member 45 is provided at one end of a rod-like body member 48 with a flange portion 46 and at its opposite end with a flange portion 47. The flange portion 46 is provided for mounting the stud retainer 45 in the hole 26 provided therefor in the closed end 17 of the hollow tubular member 15 of the piston assembly 12 described above with respect to FIGS. 3 and 4. The flange portion 47 of the stud retainer 45 is provided for coupling the stud retainer 45 to the spring guide member 13 which will be described hereinafter with respect to FIGS. 9 and 10.

Referring to FIGS. 9 and 10, the spring guide member 13 is provided with a hollow body member 51. At one end of the body 51 there is provided a slot 52 and a hole 53 for receiving the flange portion 47 and the body member 48 of the stud retainer member 45. The opposite end of the body member 51 of the spring guide member 13 is provided with a flange portion 54 for retaining a spring 60 to be described below with respect to FIG. 13.

Referring to FIGS. 11 and 12, there is provided in accordance with the present invention a set screw designated generally as 55. The set screw 55 is provided with a threaded portion 56 for threadably engaging one of the holes 18–21 in the hollow tubular member 15 for locking the base 30 thereto as will be described below with respect to FIGS. 14–18.

Referring to FIG. 13, the spring 60 is mounted coaxially with the stud retainer member 45 and the hollow body member 51 of the spring guide member 13 in the interior of the hollow tubular member 15. The base member 30 is threaded onto the closed end 17 of the hollow tubular member 15 for adjusting the opening of the passageway therein as will be described with respect to FIGS. 14–18.

As can be seen by reference to FIG. 2, in operation, when the firearm 1 is fired and the slide 2 is moved to its rearwardmost position, the spring guide member 13 and the hollow tubular member 15 are telescoped together compressing the spring 60 in a spring receiving space provided therefor between the guide spring member 13 and the interior of the hollow tubular member 15.

As the spring guide member 13 is moved into the interior of the hollow tubular member 15 compressing the spring 60, the closing of the cylinder 8 about the hollow tubular member 15 cooperates with the hollow tubular member 15 for compressing air in the cylinder 8. As the air in the cylinder 8 is compressed, the air in cooperation with the spring 60 retards the rearward movement of the slide 2.

As the air is compressed in the cylinder 8, it also, depending on the relative positions of the hollow tubular member 15 and base member 30, escapes through the holes 18–21 provided therefor in the closed end 17 of the hollow tubular member 15 and the recesses 31–34 provided therefor in the base member 30 as shown in FIG. 2 by the arrows 61 and 62.

Referring to the path of air flow through the end 17 of the hollow tubular member 15 and the recesses in the base 30, it may be seen that as the air flows through the holes 18–21 in the closed end 17 of the hollow tubular member 15, it encounters one or more of the recesses 31–34 in the base member 30. When it encounters one of the recesses 31–34 in the base member 30, the air is directed outwardly around the closed end 17 of the hollow tubular member 15 and forwardly into the cavity 10 as seen in FIG. 1. The amount of air which thus escapes from the cylinder 8 through the holes provided therefor in the end 17 of the hollow tubular member 15 is controlled by an adjustment of the relative position of the base member 30 and the hollow tubular member 15 as will be described with respect to FIGS. 14–18.

Referring to FIGS. 14–18, when the holes 18–22 in the end 17 of the hollow tubular member 15 are placed in registration with the recesses 31–34 in the base member 30 as shown in FIG. 14, the air passageways or vents, as they are commonly called, are positioned for maximum air flow and are therefore designated as being open. When the holes 18–22 and recesses 31–34 are slightly out of registration, they are said to be three-quarters open as shown in FIG. 15. Similarly with still further relative movement of the holes 18–22 with respect to the recesses 31–34, the holes or vents may be positioned in positions of being half open or one-quarter opened as shown in FIGS. 15 and 17, respectively. Finally when the holes 18–22 and the recesses 31–34 are no longer in registration at all, they are then considered to be closed as shown in FIG. 18. It is of course clear that by placing the set screw 55 in a number of the holes 35–39 provided therefor in the base member 30, a wide variety of openings of the passageways or vents may be obtained and secured.

While a preferred embodiment of the invention is disclosed and described and a number of modifications are suggested, still other changes and modifications to the embodiment described will occur to those skilled in the art and may be employed without departing from the spirit and the scope of the present invention. For example, the spring 60 and spring guide member 13 described above with respect to FIGS. 9, 10 and 13 could be employed in another part of the firearm and could be separated from the air compressing means formed by the hollow tubular member 15 and cylinder 8. Similarly, and particularly in an embodiment as just described, means for removing compressed air from the cylinder 8 may be employed in the walls of the cylinder 8 where it is not employed in the base of the piston assembly 12.

For the foregoing reasons it is intended that the present invention not be limited to the embodiments described or suggested herein, but rather be determined by reference to the claims hereinafter provided and their equivalents.

I claim:

1. A slide decelerator assembly for a firearm having a slide which moves when said firearm is fired comprising:

a cylinder for containing compressed air;

a piston assembly including a hollow tubular member having an open end and a closed end, means forming a first air passageway in said closed end, a base member, means forming a second air passageway in said base member for communication with said first air passageway, and means for movably mounting said base member to said closed end of said hollow tubular member for adjusting the compressing of air in said cylinder in response to said slide movement.

2. An assembly according to claim 1 comprising a spring means located in said cylinder which is compressible in response to said slide movement.

3. An assembly according to claim 2 comprising a spring guide means for guiding said spring means in said cylinder as said spring means is compressed.

4. An assembly according to claim 3 wherein said spring means comprises a helical spring means and said spring guide means comprises a rod means extending along the axis of said helical spring means.

5. An assembly according to claim 1 comprising:

a spring guide member having a diameter for providing a spring receiving space between the interior of said hollow tubular member and said spring guide member;

a stud retainer;

means for mounting a first end of said stud retainer in the interior of said hollow tubular member to said closed end thereof;

means for movably coupling a second end of said stud retainer and said spring guide member, said spring guide member being movable into and from the interior of said hollow tubular member in a telescoping fashion;

spring means;

means for mounting said spring means coaxially with said spring guide member and said stud retainer; and means for compressing said spring means when said spring guide member is moved into said hollow tubular member.

* * * * *